United States Patent [19]

Phillips

[11] Patent Number: 4,802,620

[45] Date of Patent: Feb. 7, 1989

[54] GABLE TOP CARTON FOR PREVENTING WICKING

[75] Inventor: Robert D. Phillips, Avon Lake, Ohio

[73] Assignee: Champion International Corporation, Stamford, Conn.

[21] Appl. No.: 176,623

[22] Filed: Apr. 1, 1988

[51] Int. Cl.[4] ..... B65D 5/06

[52] U.S. Cl. ..... 229/125.42; 206/631.3; 229/3.1; 229/137

[58] Field of Search ..... 229/3.1, 137, 125.42, 229/48 T; 206/621.1, 621.2, 631.3

[56] References Cited

U.S. PATENT DOCUMENTS

| | | | |
|---|---|---|---|
| 2,079,876 | 5/1937 | Reiter | 229/125.42 |
| 2,246,755 | 6/1941 | Reiter | 206/621.1 |
| 3,214,079 | 10/1965 | Andrews et al. | 229/137 |
| 3,399,820 | 9/1968 | Foster et al. | 206/621.1 |
| 3,604,317 | 9/1971 | Baun | 493/291 |
| 3,604,613 | 9/1971 | Haas et al. | 229/3.1 |
| 4,192,446 | 3/1980 | Naito | 229/137 |
| 4,583,679 | 4/1986 | Johnson | 229/3.1 |
| 4,617,211 | 10/1986 | Fries, Jr. | 229/3.1 |

*Primary Examiner*—Stephen Marcus

*Assistant Examiner*—Gary E. Elkins

*Attorney, Agent, or Firm*—Evelyn M. Sommer

[57] ABSTRACT

A blank for forming a gable top carton is provided along with the carton formed therefrom. The blank comprises first through fourth side panels and a side glue panel consecutively articulated to one another along parallel fold lines for defining the side walls of the gable top carton to be formed from the blank. Top and bottom panels are articulated to the opposed ends of the respective side panels and glue panel. The blank further comprises a skived flap extending entirely along one edge of the blank and adjacent the glue panel and the top and bottom panels articulated to the glue panel. The skived flap is defined by a rabbeted portion extending into the exterior surface of the blank, and is appropriately dimensioned to enable the skived flap to be folded over onto the exterior surface of the blank along the entire length of the edge. The skived flap can be adhered in face-to-face contact with the exterior surface of the blank to ensure that the liquid stored in the gable top carton formed from the blank does not directly contact the edge of the paperboard material, thereby preventing wicking of liquid through the paperboard material.

6 Claims, 2 Drawing Sheets

GABLE TOP CARTON FOR PREVENTING WICKING

BACKGROUND OF THE INVENTION

Gable top cartons are widely employed for pourable materials in view of the many known advantages of these cartons. In particular, gable top cartons can be manufactured inexpensively from biodegradable materials, provide safe and convenient storage and facilitate pouring. Additionally, gable top cartons can be conveniently and repeatedly opened and reclosed.

The prior art includes many very desirable gable top cartons, including prior art efforts to enhance the sealing of the gable top carton, to facilitate the initial opening of the carton and/or to make the gable top carton better suited for the product to be stored therein.

One desirable gable top carton is shown in U.S. Pat. No. 4,558,814 which issued to Ihde on Dec. 17, 1985. U.S. Pat. No. 4,558,814 shows a gable top carton having first through fourth generally rectangular side panels consecutively articulated to one another, and a generally rectangular side seam flap articulated to the fourth side panel. First through fourth top and bottom flaps are articulated to the opposed ends of the first through fourth side panels respectively, while top and bottom seam flaps are articulated to the opposed ends of the side seam flap. The blank for forming the carton shown in U.S. Pat. No. 4,558,814 further comprises a reinforcing tab extending from both the side seam flap and the bottom seam flap. The reinforcing tab has no score lines and is rabbeted to define a thickness less than the remainder of the blank. The unscored reinforcing tab is folded over adjacent portions of the side seam flap and the bottom seam flap to perform a reinforcing function at the bottom corner of the resulting carton.

Another gable top carton is shown in U.S. Pat. No. 4,185,765 which issued to McLaren on Jan. 29, 1980. The blank from which the carton in U.S. Pat. No. 4,185,765 is formed also comprises four side wall panels and a glue panel consecutively articulated to one another and further comprises top and bottom panels articulated to opposed ends of the respective side panels and the glue panel. Score lines are defined on selected top and bottom panels to enable the gable top construction. However, the carton shown in U.S. Pat. No. 4,185,765 is constructed to enable a hermetic sealing, and to enable the gable top to be folded over to define a generally rectangular structure when the carton is in its fully erected and sealed condition. Another carton which is folded into a generally rectangular shape when the carton is closed is shown in U.S. Pat. No. 4,520,957 which issued to Lisiecki on June 4, 1985.

U.S. Pat. No. 3,334,779, which issued to Crawford on Aug. 8, 1967 and U.S. Pat. No. 3,189,246 which issued to Seline, Jr., on June 15, 1965 both show specific constructions for sealing the carton top and for defining the pouring spout.

Still other variations of the gable top carton are shown in U.S. Pat. No. 3,349,988 which issued to Horning, U.S. Pat. No. 4,390,121 which issued to Lisiecki, U.S. Pat. No. 4,630,733 which issued to Fear and U.S. Pat. No. 4,655,386 which issued to Billberg.

Despite the many desirable features of gable top cartons in general, and the particular structural features shown in certain of the above identified patents, it has been found that in certain instances, liquids stored in a gable top carton are likely to wick into the paperboard material generally adjacent the seams thereof. The wicking will cause small amounts of liquids stored in the prior art gable top cartons to travel upwardly through the fibrous paperboard material and into the top seal area of the carton. The wicking generally is not sufficient to cause spoilage of the product stored therein or to significantly reduce the volume. However, wicking of certain colored liquids, such as fruit juices, is known to cause a clearly visually observable discoloration along the top seal area of the prior art gable top cartons. This discoloration is noticeable and often objectionable to consumers.

Accordingly, it is an object of the subject invention to provide a gable top carton that prevents discoloration adjacent the top seal area.

It is another object of the subject invention to provide a gable top carton which prevents wicking of liquids through the paperboard material and into the seal areas of the carton.

It is a further object of the subject invention to provide a blank for forming a gable top carton that will prevent wicking of liquid material and discoloration adjacent the top of the carton formed therefrom.

SUMMARY OF THE INVENTION

The subject invention is directed to a blank for forming a gable top carton, and to the gable top carton formed therefrom. The blank comprises a sheet of paperboard material with opposed interior and exterior surfaces. The interior surface of the blank comprises a continuous layer of foil, plastic or other fluid impervious material secured to the paperboard. The blank is scored to comprise first through fourth side wall panels and a side glue panel, all of which are generally rectangular and which are consecutively articulated to one another along parallel fold lines. Top panels and bottom panels are articulated respectively to opposed ends of each of the first through fourth side wall panels and the side glue panel, with the respective top panels being consecutively articulated to one another along parallel fold lines and with the respective bottom panels being consecutively articulated to one another along parallel fold lines. The top and bottom panels are scored to define the gable top construction and to enable the formation of a selectively openable pouring spout.

The portion of the blank adjacent the side glue panel and its associated top and bottom panels and opposite the fourth side wall panel defines a skived flap. This skived flap is rabbeted or skived along the entire length of the glue panel and along the corresponding edges of the top and bottom panels articulated to the glue panel. The skived portion extends inwardly from the exterior surface of the blank to leave the foiled or similarly layered interior surface of the blank intact. The skived portion of the blank extends inwardly from the extreme edge a distance sufficient to enable the skived portion to be folded over the edge of the blank and to be adhered in face-to-face contact with the outwardly facing surface of the glue panel and the top and bottom panels articulated to the glue panel.

The articulation of the top and bottom glue panels to the side glue panel is defined by a pair of spaced apart score lines.

Seal panels are articulated to the respective top panels. The articulation of the top glue panel to its associate seal panel is defined by a pair of spaced apart perforations which extend inwardly from the surface of the blank that will define the outside of the carton. More particularly, the perforations extend inwardly into the blank a distance less than the thickness of the blank. These perforations are in lieu of the score line defining the remainder of the articulations of the blank.

The carton is formed by folding the skived flap of the blank into face-to-face contact with the outwardly facing surface of the side glue panel and the top and bottom panels articulated thereto. More particularly, the skived flap is adhered in face-to-face contact with these outwardly facing surfaces of the blank. The first through fourth side panels and the side glue panel then are consecutively folded about their respective parallel articulations to define a tubular structure, and the outwardly facing surface of the side, top and bottom glue panels are adhesively affixed to the interior surface of the first side panel and its associated top and bottom panels adjacent the free edges thereof, such that the free edge of the first side panel is substantially adjacent the articulation between the side glue panel and the fourth side panel. In this glued configuration, the skived flap will be secured intermediate the side, top and bottom glue panels and the inwardly facing surface of the first panel and its top and bottom panels. Thus, the edge of the glue panel opposite the articulation of the glue panel to the fourth side panel will not be directly exposed to the liquid to be stored in the carton. Rather, the inwardly facing surface of the blank coated by foil or similar liquid impervious material will define the only portions of the blank to be exposed to the liquid to be stored in the carton.

The top and bottom flaps of the carton are then folded into the closed condition of the carton. However, the provision of the spaced apart perforation lines defining the articulation between the top glue panel and the top seal panel will further minimize the leakage of liquid material into an area of the paperboard material that could otherwise absorb the liquid and further encourage wicking.

DETAILED DESCRIPTION OF THE PREFERRED EMBODIMENTS

Figures 1, 2, 3:
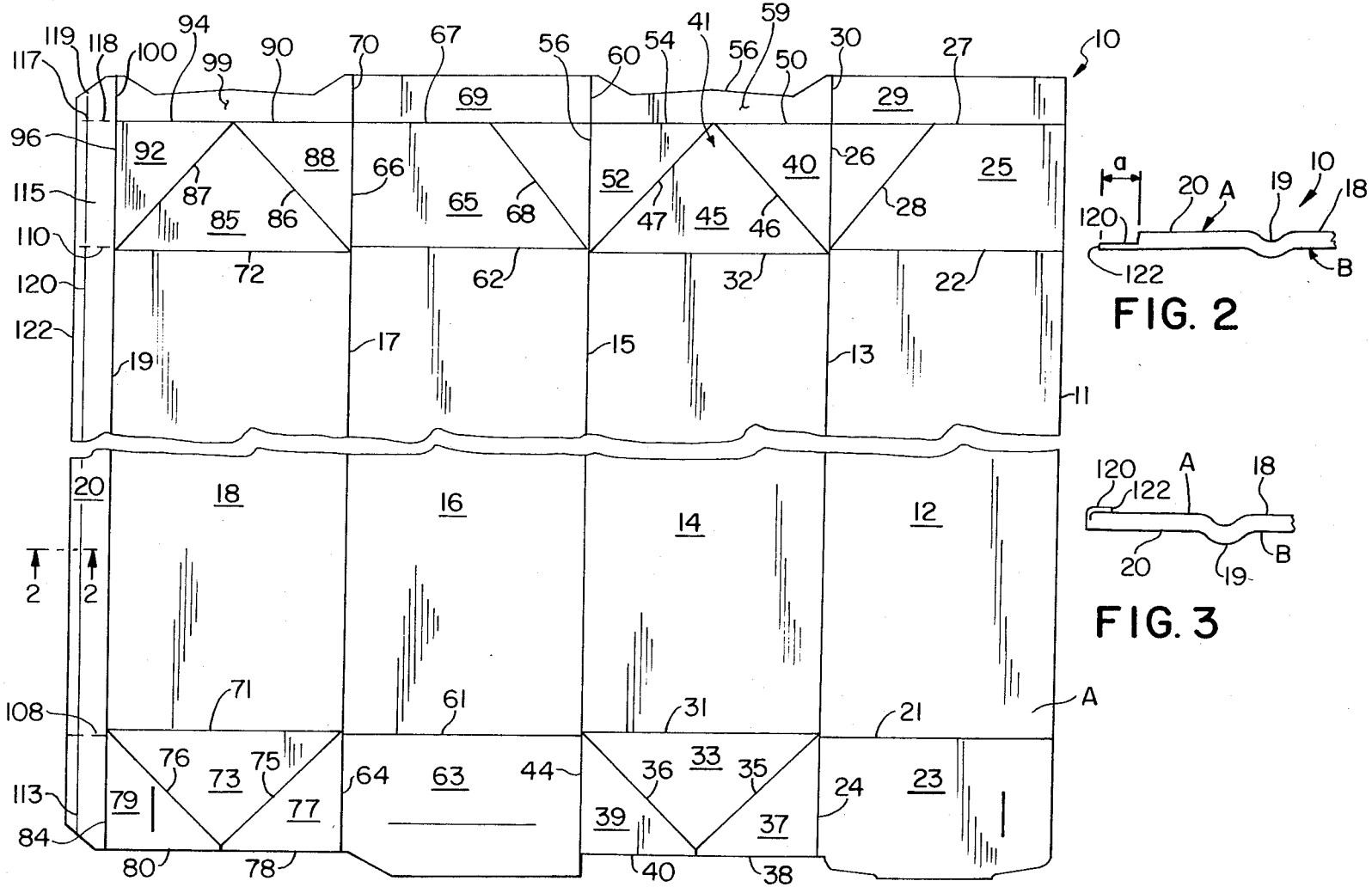
FIG. 1 is a plan view of the blank of the subject invention showing the surface of the blank that will define the exterior of the carton formed thereby.
FIG. 2 is a cross-sectional view of the blank taken along line 2—2 in FIG. 1.
FIG. 3 is a cross-sectional view similar to FIG. 2 but showing the blank in a stage during its fabrication.

The blank of the subject invention is illustrated in FIG. 1 and is identified generally by the numeral 10. The blank 10 is formed from a unitary piece of paperboard material and is provided with a plurality of score lines, perforations, and a skived portion as defined in detail herein such that the blank 10 can be folded and glued into an erected gable top carton. More particularly, one surface of the blank 10 will define the inwardly facing surface of the erected gable top carton, while the opposed surface of the blank will define the outwardly facing surface on the erected carton. The surface A of the blank 10 shown in FIG. 1 will define the outwardly facing surface of the blank 10, and typically will be printed with appropriate indicia to identify the product stored in the gable top carton. The opposed surface B of the blank 10 shown in FIGS. 2 and 3, or the surface opposite that depicted in FIG. 1, will define the inwardly facing surface on the carton erected from blank 10, and typically will be provided with a laminated foil layer or a suitable impermeable coating to adequately protect the liquid stored therein and to prevent or minimize wicking of material through the paperboard material.

The blank 10 comprises a rectangular first side panel 12, a rectangular second side panel 14, a rectangular third side panel 16, a rectangular fourth side panel 18 and a side glue panel 20 which are articulated to one another along substantially parallel fold lines 13, 15, 17 and 19 respectively.

The first side panel 12 is further defined by a linear side edge 11 of the blank 10 which is parallel to the fold line 13, and by parallel fold lines 21 and 22 which extend orthogonally between and connect the side edge 11 and the fold line 13. A first bottom panel 23 is articulated to the first side panel 12 along fold line 21. The first bottom panel 23 is further defined by the generally linear edge 11 of the blank 10 and by a fold line 24 which extends generally colinearly from the fold line 13 between the first and second side panels 12 and 14.

A rectangular first top panel 25 is articulated to the first side panel 12 along fold line 22. The first top panel 25 is further defined by the generally linear edge 11 of the blank 10, by fold line 26 which extends generally colinearly from the fold line 13 and by fold line 27 which extends orthogonally between the edge 11 of blank 10 and the fold line 26. A diagonal fold line 28 extends substantially from the intersection of fold lines 22 and 26 to a location along the fold line 27. In accordance with generally standard construction for gable top cartons, the portion of the rectangular first top panel 25 defined by score lines 26, 27 and 28 can be folded back to enable the creation of a pouring spout on the carton formed from blank 10. A top seal panel 29 is articulated to the front roof panel 25 along fold line 27. The first top seal panel 29 is further defined by a portion of the generally linear edge 11 of blank 10 and by a fold line 30 extending generally colinearly from the fold line 26.

The second side panel 14 is further defined by parallel fold lines 31 and 32 which extend orthogonally between and connect the fold lines 13 and 15. A triangular second bottom panel 33 is articualted to the second side panel 14 along fold line 31. The triangular second bottom panel 33 is further defined by fold lines 35 and 36 which extend from the opposed ends of the fold line 31 and converge toward one another to a point of intersection. Bottom fold panel 37 is articulated to the triangular second bottom panel 33 along fold line 35, and is further articulated to the first bottom panel 23 along fold line 24. The bottom fold panel 37 is further defined by edge 38. Similarly, a bottom fold panel 39 is articulated to the triangular second bottom panel 33 along fold line 36, and is further defined by edge 40 which is colinear with the edge 38 and by fold line 44 which extends generally colinearly from the fold line 15.

A triangular second top panel 45 is articulated to the second side panel 14 along fold line 32. The triangular second top panel 45 is further defined by fold lines 46 and 47 which extend from the opposite ends of the fold line 32 and converge toward one another. A top fold panel 48 is articulated to the triangular second top panel 45 along fold line 46, and is further articulated to the rectangular first top panel 25 along fold line 26. The top fold panel 48 is further defined by fold line 50 which extends between the fold lines 26 and 46. Similarly, a top fold panel 52 is articulated to the triangular second top panel 45 along fold line 47. The top fold panel 52 is further defined by fold line 54 which extends colinearly from the fold line 50 and by fold line 56 which extends colinearly from the fold line 15. A top seal panel 59 is articulated to the top fold panels 48 and 42 along colinear fold lines 50 and 54 respectively, and is further defined by fold line 60 which extends generally colinearly from the fold line 56.

The third side panel 16 is further defined by parallel fold lines 61 and 62 which extend orthogonally between the fold lines 15 and 17. A third bottom panel 63 is articulated to the third side panel 16 along fold line 61, and is further defined by fold line 64 which extends generally colinearly from the fold line 17.

A rectangular third top panel 65 is articulated to the third side panel 16 along fold line 62. The third top panel 65 is further defined by fold line 66 which extends colinearly from the fold line 17 and by fold line 67 which extends orthogonally between the fold lines 56 and 66 and generally parallel to the fold line 62. The rectangular third top panel 65 is further defined by fold line 68 which extends diagonally from the intersection of fold lines 56 and 62 to the fold line 67 such that the corner of the third top panel 65 defined by the fold line 68 can be folded back when the carton is opened for pouring. A top seal panel 69 is articulated to the third top panel 65 along fold line 67. The seal panel 69 is further defined by fold line 70 which extends generally colinearly from the fold line 66.

The fourth side panel 18 is further defined by parallel fold lines 71 and 72 which extend orthogonally between the fold line 17 and 19. A triangular fourth bottom panel 73 is articulated to the fourth side panel 18 along fold line 71, and is further defined by fold lines 75 and 76 which extend from the opposed ends of fold line 71 and converge toward one another. Bottom fold panel 77 is articulated to the triangular fourth bottom panel 73 along fold line 75 and to the thrid bottom panel 63 along fold line 64. The bottom fold panel 77 is further defined by edge 78. Similarly, a bottom fold panel 79 is articulated to the triangular fourth bottom panel 73 along fold line 76, and is further defined by edge 80 which extends generally colinearly from the edge 78, and by fold line 84 which extends generally colinearly from the fold line 19.

A triangular fourth top panel 85 is articulated to the fourth side panel 18 along fold line 72. The triangular fourth top panel 85 is further defined by fold lines 86 and 87 which extend from the opposed ends of the fold line 72 and converge toward one another. A top fold panel 88 is articulated to the triangular fourth top panel 85 along fold line 86, and is articulated to the third top panel 65 along fold line 66. The top fold panel 88 is further defined by fold line 90. Similarly, a top fold panel 92 is articulated to the triangular fourth top panel 85 along fold line 87, and is further defined by fold line 94 which extends generally colinearly from the fold line 90, and by fold line 96. Top seal panel 99 is articulated to the fold panels 88 and 92 along fold lines 90 and 94 respectively. The top seal panel 99 is articulated to the top seal panel 69 along fold line 70 and is further defined by fold line 100.

The side glue panel 20 is further defined by opposed pairs of spaced apart score lines 108 and 110 which are approximately in line with the fold lines 71 and 72 respectively. More particularly, the score lines in each pair 108 and 110 are spaced apart by approximately 0.10 inch.

A bottom glue panel 113 is articulated to the bottom fold panel 79 along fold line 84 and is articulated to the side glue panel 20 by the pair of score lines 108. A top glue panel 115 is articulated to the top fold panel 92 along fold line 96 and is articulated to the side glue panel 20 by the pair of score lines 110. The top glue panel is further defined by a pair of perforations 117 and 118 which are generally aligned with the fold line 94 and generally parallel to the pairs of score lines 108 and 110.

A top seal panel 119 is articulated to the top seal panel 99 along fold line 100 and is articulated to the top glue panel 115 along spaced apart perforations 117 and 118. The perforations 117 and 118 extend approximately 0.015 inch deep into the exterior surface A of the blank 10.

A skived flap 120 extends along the edge 122 of the blank 10 opposite edge 11 thereof. In particular the skived flap 120 is adjacent the side glue panel 20, the bottom glue panel 113, the top glue panel 115 and the top seal panel 119. The skived flap 120 defines a reduced thickness or rabbeted portion extending into the exterior surface A. The skived flap 120 has a width "a" which is sufficient to enable the skived flap 120 to be folded over the adjacent portion of the side glue panel 20. Preferably, the width "a" exceeds the thickness of the blank 10, and typically will be between 0.10 and 0.25 inch.

The blank 10 is formed into a gable top carton 124 by first folding the skived flap 104 onto the exterior surface A adjacent the edge 122 of blank 10. More particularly, as shown in FIGS. 2 and 3, the skived flap 120 is adhered securely in face-to-face contact with the exterior surface A of the glue panels 20, 113, 115 and 119. The first through fourth side panels 12, 14, 16 and 18 and the side glue panel 20 all are consecutively rotated about the fold lines 13, 15, 17 and 19 to define a generally tubular structure, and the glue panels 20, 113, 115 and 119 are adhered to the interior surface B of the blank 10 adjacent the edge 11 thereof. The respective base and roof of the gable top carton are then formed by folding the appropriate bottom panels 23, 33, 63 and 73 about the fold lines 21, 31, 61 and 71 and the corresponding top panels 25, 45, 65 and 85 about the fold lines 22, 32, 62 and 72. As part of this closing of the opposed ends to define the gable top carton, the bottom glue panel 113 and the roof glue panel 115 will rotate about the associated pairs of spaced apart score lines 108 and 110 at the appropriate respective location. However, the absence of a clearly identified continuous score line for these articulations avoids a distinct channel through which liquid stored in the gable top carton can flow. Similarly, the perforations 117 and 118 at the top seal provides an efficient articulation line but also provides a discontinuity in the paperboard to reduce the ability of the liquid to wick into the top seal area.

Figure 4:
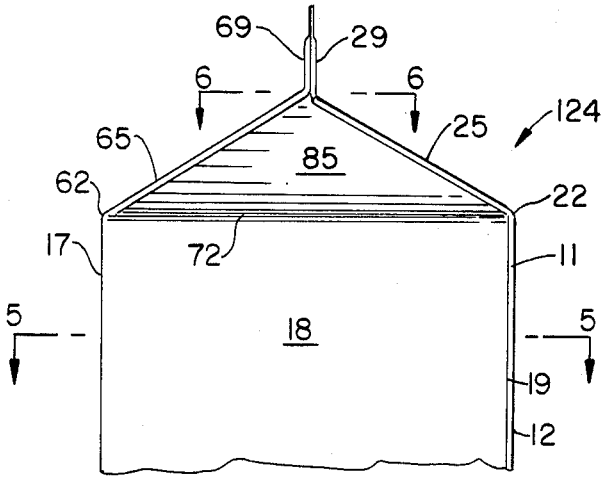
FIG. 4 is a side elevational view of a carton erected from the blank shown in FIG. 1.
Figure 5:
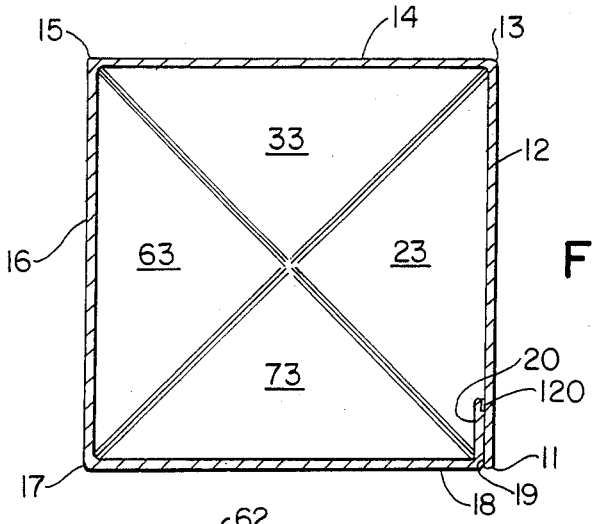
FIG. 5 is a cross-sectional view taken along line 5—5 in FIG. 4.
Figure 6:
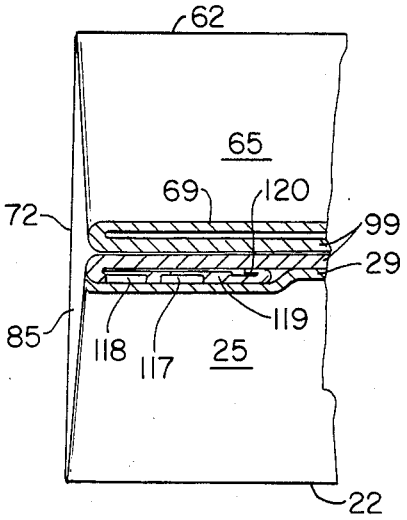
FIG. 6 is a cross-sectional view taken along line 6—6 in FIG. 4.

The resulting carton 124 is shown most clearly in FIGS. 4–6. As shown most clearly in FIGS. 5 and 6, the folded orientation of the skived flap 120 insures that the liquid materials stored in the gable top carton 124 will not directly contact a free edge of the paperboard material, thereby insuring that wicking of the liquid material into and through the paperboard material will be prevented substantially along the entire inside of the carton 124. Additionally, as shown in FIG. 6, the spaced apart perforations separating the top glue panel from the top seal panel insure properly oriented fold therebetween but minimize the paperboard material through which wicking could occur.

While the invention has been described with respect to a preferred embodiment, it is apparent that changes can be made without departing from the scope of the invention as defined by the appended claims.

What is claimed is:

1. A blank for forming a gable top carton, said blank being formed from a single sheet of foldable stock material comprising a layer of paperboard material having opposed first and second surfaces and a layer of substantially fluid impervious material secured in face-to-face relationship with said paperboard material such that said fluid impervious material defines said first surface of said blank and the surface of said blank opposite said first surface defining a second surface thereof, said blank comprising first through fourth generally rectangular side wall panels and a side glue panel consecutively articulated to one another along parallel fold lines, first through fourth base panels and first through fourth top panels articulated respectively to said first through fourth side panels along fold lines extending substantially orthogonal to the consecutive articulations between said first through fourth side panels, a bottom glue panel, a top glue panel articulated to opposite ends of said side glue panel, a skived flap extending continuously along an edge of said blank and adjacent said side glue panel and said bottom glue panel and top glue panel, said skived flap being defined by a skived portion extending into the second surface of said blank and top seal panels articulated to the top panels of said blank, the articulation of the top glue panel to the associated top seal panel being defined by a pair of spaced apart perforations extending into the exterior surface of the blank.

2. A blank as in claim 1 wherein the skived portion extends into the blank a major portion of the thickness of the paperboard material comprising said blank.

3. A blank as in claim 1 wherein the width of said skived flap measured perpendicular to said edge of said blank is greater than the thickness of the blank.

4. A blank as in claim 1 wherein the width of said skived flap measured perpendicular to the edge of said blank is of a dimension sufficient to enable a portion of said skived flap to be folded into face-to-face contact with the second surface of said blank.

5. A blank as in claim 1 wherein the width of said skived flap measured perpendicular to the edge of said blank is between approximately 0.1 inch and 0.25 inch.

6. A blank as in claim 1 comprising opposed pairs of spaced apart score lines defining the respective articulations between said side glue panel and the respective top and bottom glue panels.

* * * * *